US005946801A

United States Patent [19]

Twigg et al.

[11] Patent Number: 5,946,801

[45] Date of Patent: Sep. 7, 1999

[54] METHOD OF MAKING A FIBRE REINFORCED METAL COMPONENT

[75] Inventors: Edwin S Twigg; Charles R Talbot; Phillip J Doorbar, all of Derby, United Kingdom

[73] Assignee: Rolls-Royce plc, London, United Kingdom

[21] Appl. No.: 08/927,177

[22] Filed: Sep. 11, 1997

[30] Foreign Application Priority Data

Sep. 24, 1996 [GB] United Kingdom ..... 9619890

[51] Int. Cl.[6] ..... B23D 15/00

[52] U.S. Cl. ..... 29/889.71; 29/889.7; 29/889.2

[58] Field of Search ..... 29/889.71, 889.7, 29/889.2, 458, 530

[56] References Cited

U.S. PATENT DOCUMENTS

| | | | |
|---|---|---|---|
| 3,711,936 | 1/1973 | Athey et al. | 29/889.71 |
| 4,907,736 | 3/1990 | Doble | 29/889.71 |
| 4,919,594 | 4/1990 | Wright et al. | 29/889.71 |
| 5,127,802 | 7/1992 | Carlson et al. | 29/889.71 |
| 5,427,304 | 6/1995 | Woods et al. . | |
| 5,462,408 | 10/1995 | Coffy | 29/889.71 |
| 5,544,805 | 8/1996 | Alasssoeur et al. . | |
| 5,562,245 | 10/1996 | Berthelemy et al. . | |

FOREIGN PATENT DOCUMENTS

| | | |
|---|---|---|
| 2196566 | 5/1988 | United Kingdom . |
| 2198675 | 6/1988 | United Kingdom . |

*Primary Examiner*—I. Cuda
*Attorney, Agent, or Firm*—W. Warren Taltavull; Farkas & Manelli PLC

[57] ABSTRACT

A ceramic fibre reinforced metal rotor is manufactured from a first metal ring, a second metal ring and a plurality of fibre preforms. Each fibre preform includes a metal coated ceramic fibre arranged in a spiral. An annular groove is formed in an axial face of the first metal ring and the fibre preforms are arranged in the annular groove. An annular projection is formed on an axial face of the second metal ring and two annular grooves are formed on opposite radial sides of the annular projection. The second metal ring is arranged such that the annular projection is aligned with the annular groove of the first metal ring. Heat and pressure is applied to axially consolidate the fibre preforms and to bond the first metal ring, the second metal ring and the fibre preforms to form a unitary composite component. The grooves allow axial movement of the projection and control consolidation.

26 Claims, 3 Drawing Sheets

METHOD OF MAKING A FIBRE REINFORCED METAL COMPONENT

THE FIELD OF THE INVENTION

The present invention relates to a method of manufacturing fibre reinforced metal cylinders, for example metal rings and metal discs.

BACKGROUND OF THE INVENTION

The ideal arrangement for a fibre reinforced metal ring, or disc, is to arrange the fibres circumferentially such that they extend continuously without breaks in a fully dense metal matrix. This is difficult to achieve because a certain amount of movement is required in practice to achieve good diffusion bonding, and density, between the layers of fibres. The fibres used to reinforce the metal matrix are ceramic, and ceramic fibres have very low extension to failure values, typically 1%. On consolidation using radial pressure from the inside surface of the ring the continuous ceramic fibres are placed under high tensile stress resulting in fibre breakage and loss of structural integrity. On consolidation using radial pressure from the outer surface of the ring the continuous ceramic fibres are buckled which reduces structural integrity. On consolidation using radial pressure from both the inside and outside surfaces of the ring the continuous ceramic fibres either break under high tensile stress for the radially inner layers of ceramic fibres or buckle for the radially outer layers of ceramic fibres. This resulting fibre reinforced metal ring therefore contains many random fibre breaks and thus the fibre reinforced metal ring has unknown levels of mechanical properties.

In one known method of manufacturing a fibre reinforced metal ring, as disclosed in UK patent application No. GB2168032A, a filament is wound spirally in a plane with a matrix metal spiral between the turns of the fibre spiral. The fibre spiral and matrix metal spiral are positioned between discs of matrix metal, and is then pressed axially to consolidate the ring structure. This produces little or no breaking of the fibres.

In a further known method of manufacturing a fibre reinforced metal ring, as disclosed in UK patent application No. GB2070833A, a metal matrix tape, which has reinforcing fibres, is wound onto a mandrel and then inserted into a metal shaft. The fibres are arranged to extend generally axially of the shaft. The assembly is pressed to consolidate the ring structure. This method does not have the ideal arrangement of fibres for a ring.

Another known method of manufacturing a fibre reinforce metal ring, as disclosed in UK patent application No. GB2198675A, a continuous helical tape of fibres and a continuous helical tape of metal foil are interleaved. The interleaved helical tapes of fibres and metal foil are placed in an annular groove in a metal member and a metal ring is placed on top of the interleaved helical tapes of fibres and metal foil. The metal ring is pressed axially to consolidate the assembly and to diffusion bond the metal ring, the metal member and the interleaved helical tapes of fibres and metal foil together to form an integral assembly. This method produces little or no breaking of the fibres. This method requires the use of a vacuum chamber and a hot press and die.

SUMMARY OF THE INVENTION

The present invention seeks to provide a novel method of manufacturing fibre reinforced metal components.

The present invention provides a method of manufacturing a fibre reinforced metal component comprising the steps of:

(a) forming a longitudinally extending groove in a face of a first metallic member, (b) arranging at least one longitudinally extending fibre and filler metal in the groove in the first metallic member, (c) forming a longitudinally extending projection on a face of a second metallic member, (d) arranging the second metallic member such that the longitudinally extending projection of the second metallic member is aligned with the longitudinally extending groove of the first metallic member and such that two longitudinally extending chambers are formed between the said faces of the first and second metallic members, the longitudinally extending chambers being arranged transversely on opposite sides of the longitudinally extending projection, (e) applying heat and pressure such that the longitudinally extending projection moves into the longitudinally extending groove to consolidate the at least one longitudinally extending fibre and the filler metal and to bond the first metallic member, the second metallic member, the at least one longitudinally extending fibre and the filler metal to form a unitary composite component.

The method may comprise forming a circumferentially extending groove in an axial face of the first metallic member, arranging at least one circumferentially extending fibre and filler metal in the groove in the first metallic member, forming a circumferentially extending projection on an axial face of the second metallic member, arranging the second metallic member such that the circumferentially extending projection of the second metallic member is aligned with the circumferentially extending groove of the first metallic member and such that two circumferentially extending chambers are formed between the said faces of the first and second metallic members, the circumferentially extending chambers being arranged radially on opposite sides of the circumferentially extending projection, applying heat and pressure such that the circumferentially extending projection moves into the circumferentially extending groove to axially consolidate the at least one circumferentially extending fibre and the filler metal and to bond the first metallic member, the second metallic member, the at least one circumferentially extending fibre and the filler metal to form a unitary composite component.

Preferably the method comprises the step of sealing the periphery of the first metallic member to the periphery of the second metallic member after step (d) and before step (e).

Preferably step (e) comprises hot isostatic pressing.

The first metallic member may comprise a ring or a disc and the second metallic member may comprise a ring or a disc.

The at least one circumferentially extending fibre and filler metal may comprise a single metal coated fibre, a plurality of metal coated fibres, a single fibre and a single metal wire, a plurality of fibres and a plurality of metal wires, a single fibre and metal powder, a plurality of fibres and metal powder, a single fibre and a metal foil, or a plurality of fibres and a plurality of metal foils The at least one circumferentially extending fibre and filler metal may comprise a helical tape of fibres and a helical tape of metal or one or more metal coated fibres, each metal coated fibre is wound in a spiral to form a disc shaped preform.

The first metallic member and the second metallic member may comprise titanium, titanium aluminide, an alloy of titanium, or any suitable metal, alloy or intermetallic which is capable of being bonded.

The at least one circumferentially extending fibre may comprise silicon carbide, silicon nitride, boron, alumina, or other suitable fibre.

The filler metal may comprise titanium, titanium aluminide, an alloy of titanium, or any suitable metal, alloy or intermetallic which is capable of being bonded.

The sealing of the periphery of the first metallic member to the periphery of the second metallic member may comprising welding.

The method may additionally comprise the step of machining the unitary composite component to a predetermined shape after step (e).

The machining may comprise machining the unitary composite component to remove at least a portion of the second metallic member and at least a portion of the bond between the first metallic member and the second metallic member.

The machining may comprise machining at least one axial or circumferential groove in the periphery of the unitary composite component, for receiving rotor blade attachment features.

The machining may comprise machining the periphery of the unitary composite component to form at least one rotor blade integral with the unitary composite component.

The unitary composite component may be electrochemically machined to form the at least one rotor blade.

The method may additionally comprise the step of welding at least one rotor blade to the unitary composite component.

The at least one rotor blade may be welded onto the unitary composite component by friction welding or electron beam welding.

The chambers between the said faces of the first and second metallic members may be tapered transversely from the face of the first metallic member to the base of the projection. The chambers may taper in a straight line or taper in a curve. The shape of the chambers may be tailored to control the movement of the projection of the second metallic member into the groove in the first metallic member during the consolidation and bonding step.

The at least one circumferentially extending fibre may have adhesive to hold the fibre in a preform.

The projection may have axial grooves to allow the adhesive to be removed from the at least one circumferentially extending fibre in the circumferentially extending groove in the first metallic member.

The chambers between the said faces of the first and second metallic members may be formed by machining two grooves in said face of the second metallic member. Alternatively the chambers between the said faces of the first and second metallic members may be formed by locating at least one third metallic member between the first and second metallic members and spacing the at least one third metallic member from the projection on the second metallic member.

The present invention also provides a method of manufacturing a fibre reinforced metal component comprising the steps of:

(a) forming a circumferentially extending groove in an axial face of a first metallic member, (b) arranging at least one circumferentially extending fibre and filler metal in the groove in the first metallic member, (c) forming a circumferentially extending projection on an axial face of a second metallic member, (d) arranging the second metallic member such that the circumferentially extending projection of the second metallic member is aligned with the circumferentially extending groove of the first metallic member and such that two circumferentially extending chambers are formed between the said axial faces of the first and second metallic members, the circumferentially extending chambers being arranged radially on opposite sides of the circumferentially extending projection, (e) applying heat and pressure such that the circumferentially extending projection moves into the circumferentially extending groove to axially consolidate the at least one circumferentially extending fibre and the filler metal and to bond the first metallic member, the second metallic member, the at least one circumferentially extending fibre and the filler metal to form a unitary composite component.

BRIEF DESCRIPTION OF THE DRAWINGS

The present invention will be more fully described by way of example with reference to the accompanying drawings, in which.

DETAILED DESCRIPTION OF THE INVENTION

Figure 1:
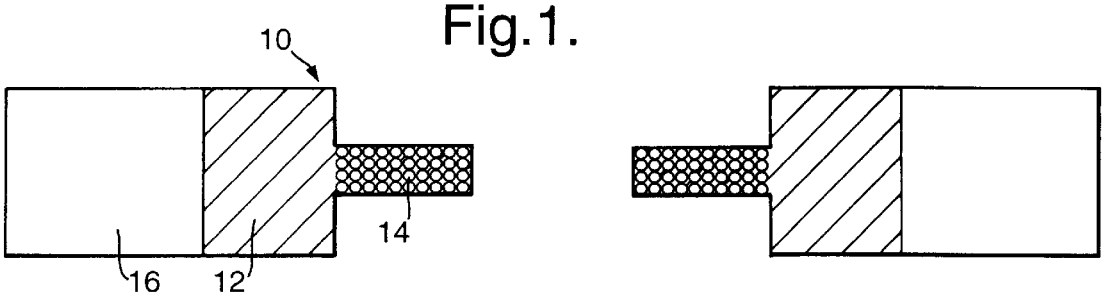
FIG. 1 is a longitudinal cross-sectional view through a bladed compressor rotor made according to the method of the present invention.

A finished ceramic fibre reinforced metal rotor 10 with integral rotor blades is shown in FIG. 1. The rotor 10 comprises a metal ring 12 which includes a ring of circumferentially extending reinforcing ceramic fibres 14, which are fully diffusion bonded to the metal ring 12. A plurality of solid metal rotor blades 16, extend radially outwardly from and are integral with the metal ring 12.

Figure 2:
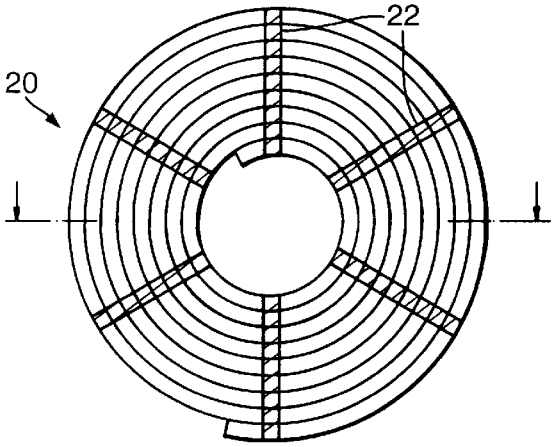
FIG. 2 is a plan view of a fibre preform used in the method of the present invention.
Figure 3:
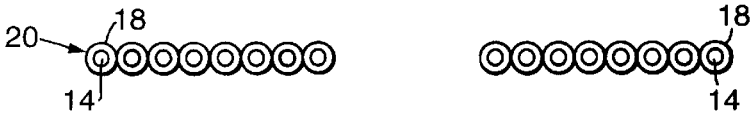
FIG. 3 is a cross-sectional view through the preform shown in FIG. 2.

The ceramic fibre reinforced metal rotor 10 is manufactured using a plurality of metal coated ceramic fibres. Each ceramic fibre 14 is coated with metal matrix 18 by any suitable method, for example physical vapour deposition, sputtering etc. Each metal coated 18 ceramic fibre 14 is wound around a mandrel to form an annular, or disc shaped, fibre preform 20 as shown in FIGS. 2 and 3. Each annular, or disc shaped, fibre preform 20 thus comprises a single metal coated 18 ceramic fibre 14 arranged in a spiral with adjacent turns of the spiral abutting each other. A glue 22 is applied to the annular, or disc shaped, fibre preform 20, at suitable positions, to hold the turns of the spiral together. The glue is selected such that it may be completely removed from the annular, or disc shaped, fibre preform 20 prior to consolidation. The glue may for example be polymethylmethacrylate in di-chloromethane or perspex in di-chloromethane.

Figure 4:
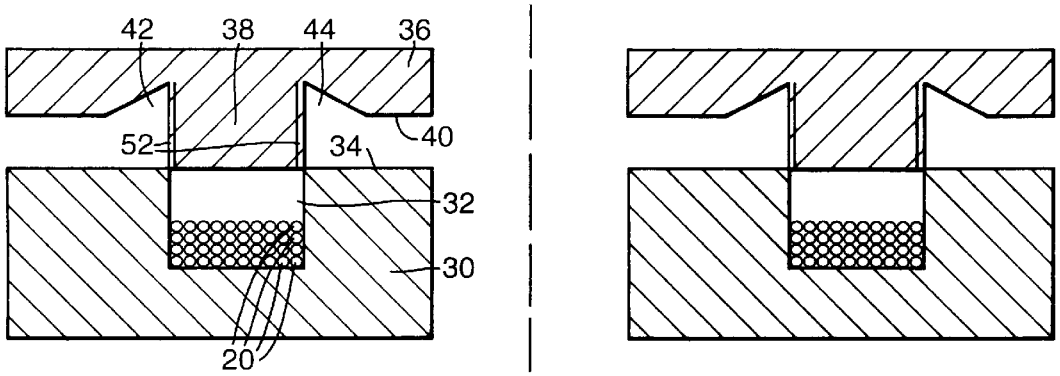
FIG. 4 is a longitudinal cross-sectional view through an assembly of fibre preforms positioned between first and second metallic members.

A first metal ring, or a metal disc, 30 is formed and an annular axially extending groove 32 is machined in one axial face 34 of the first metal ring 30, as shown in FIG. 4. The annular groove 32 has straight parallel sides which forms a rectangular cross-section. A second metal ring, or a metal disc, 36 is formed and an annular axially extending projection 38 is machined from the second metal ring 30 such that it extends from one axial face 40 of the second metal ring 36. The second metal ring 30 is also machined to form two annular grooves 42 and 44 in the face 40 of the second metal ring 36. The grooves 42 and 44 are arranged radially on either side of the annular projection 38 and the grooves 42 and 44 are tapered radially from the axial face 40 to the base of the annular projection 38. The grooves 42 and 44, as shown in FIG. 4, taper in a straight line radially to form a triangular cross-section, however the grooves 42 and 44 may taper with a smooth curve. It may be possible to have straight parallel sided grooves which form rectangular cross-sections. It is to be noted that the radially inner and outer dimensions, diameters, of the annular projection 38 are substantially the same as the radially inner and outer dimensions, diameters, of the annular groove 32.

One or more annular fibre preforms 20 are positioned in the annular groove 32 in the axial face 34 of the first metal ring 30. The radially inner and outer dimensions, diameters, of the annular fibre preforms 20 are substantially the same as the radially inner and outer dimensions, diameters, of the annular groove 32 to allow the annular fibre preforms 20 to be loaded into the annular groove 32 while substantially filling the annular groove 32. A sufficient number of annular fibre preforms 20 are stacked one upon the other in the annular groove 32 to partially fill the annular groove 32 to a predetermined level.

Figure 5:
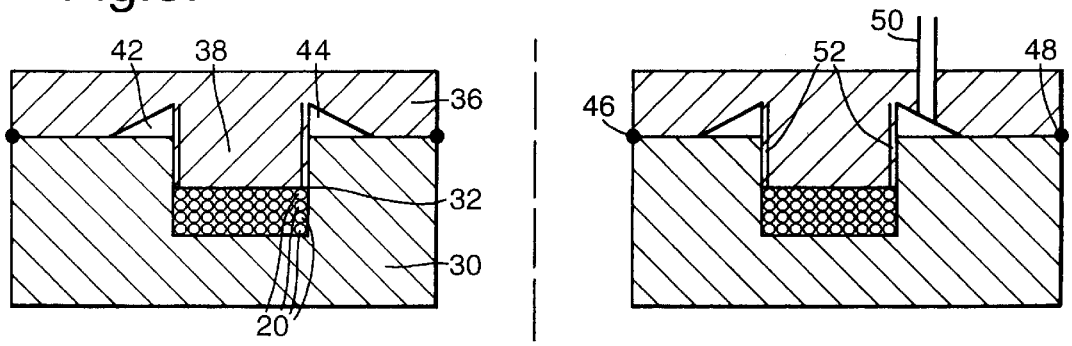
FIG. 5 is a longitudinal cross-sectional view through the assembly of fibre preforms positioned between first and second metallic members after welding together.

The second metal ring 36 is then arranged such that the axial face 40 confronts the axial face 34 of the first metal ring 30, and the axes of the first and second metal rings 36 are aligned such that the annular projection 38 on the second metal ring 36 aligns with annular groove 32 in the first metal ring 30. The second metal ring 36 is then pushed towards the first metal ring 30 such that the annular projection 38 enters the annular groove 32 and is further pushed until the axial face 40 of the second metal ring 36 abuts the axial face 34 of the first metal ring 30, as shown in FIG. 5. The grooves 42 and 44 in the second metallic ring 36 effectively form chambers between the confronting faces 34 and 40 of the first and second metallic rings 30 and 36.

The radially inner and outer peripheries of the axial face 34 of the first metallic member 30 are sealed to the radially inner and outer peripheries respectively of the axial face 40 of the second metallic member 36 to form a sealed assembly. The sealing is preferably by TIG welding, electron beam welding, laser welding or other suitable welding process to form inner annular weld seal 46 and outer annular weld seal 48.

The second metal ring 36 is provided with a pipe 50 which extends through a hole in the second metal ring 36 and which is connected to the annular groove, or chamber, 42, or to the annular groove, or chamber, 44. The annular projection 38 is provided with one or more axially extending, circumferentially arranged, slots 52. The pipe 50 is connected to a vacuum pump and the sealed assembly is then evacuated. The sealed assembly is then heated, while being continuously evacuated to evaporate the glue from the annular fibre preforms 20. The axially extending slots 52 on the projection 38 allows the evaporated glue to flow out of the annular groove 32 to the annular grooves, or chambers, 42 and 44, from where the evaporated glue flows through the pipe 50 out of the sealed assembly. The annular projection 38 prevents movement of the metal coated 18 ceramic fibres 14 of the annular fibre preforms 20 once the glue has been removed.

After all the glue has been removed from the annular fibre preforms 20, and the interior of the sealed assembly is evacuated, the pipe 50 is sealed. The sealed assembly is then heated to diffusion bonding temperatures and isostatic pressure is applied to the sealed assembly, this is known as hot isostatic pressing, and this results in axial consolidation of the annular fibre preforms 20 and diffusion bonding of the first metal ring 30 to the second metal ring 36 and diffusion bonding of the metal on the metal coated 18 ceramic fibres 14 to the metal on other ceramic fibres 14, to the first metal ring 30 and to the second metal ring 36. During the hot isostatic pressing the pressure acts equally from all directions on the sealed assembly, and this causes the annular projection 38 to move axially into the annular groove 32 to consolidate the annular fibre preforms 20.

The movement of the annular projection 38 is allowed by the provision of the annular grooves 42 and 44 on the second metal ring 36 which form chambers between the confronting faces 34 and 40 of the first and second metal rings 30 and 36. The annular grooves 42 and 44 prevent or reduce radial inward movement of the first metal ring 30 until the annular grooves, or chambers, 42 and 44 have been closed up, at which time the annular fibre preforms 20 have been consolidated to approximately full density. The annular grooves, or chambers, 42 and 44 are very important because any radial movement of the first metal ring 30 during consolidation will cause the first metal ring 30 to press against the annular projection 38 causing the annular projection 38 to become pinched. This then would lead to loss of control of the direction of consolidation and loss of control of the cross-sectional shape of the reinforced portion of the resulting fibre reinforced metal component. The control of the consolidation direction enables the size, shape and position of the reinforced portion to be controlled, which is important if the resulting fibre reinforced metal component is to be machined to form a finished component.

The shape of the grooves, or chambers, 42 and 44 may be tailored to control the movement of the projection 38 of the second metal ring 36 into the groove 32 in the first metal ring 30 during the consolidation and bonding step, for example to make the annular projection 38 move with a radially outward directional component. Also the other axial face of the second metal ring 36 may be of any suitable shape, for example planar or tapered from its periphery to the region around the projection 38.

Figure 6:
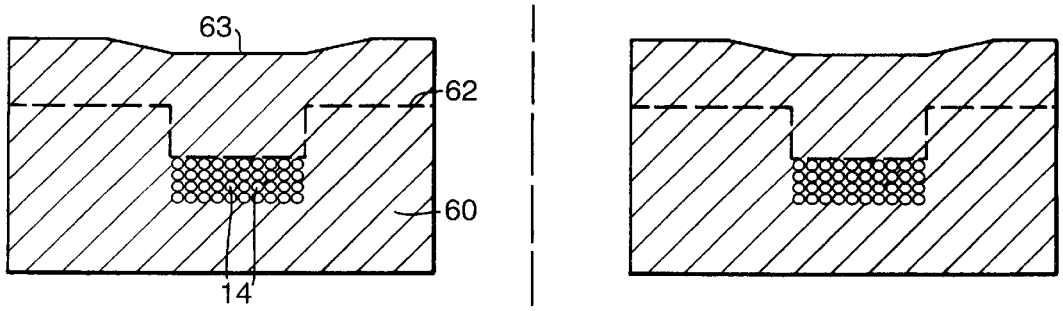
FIG. 6 is a longitudinal cross-sectional view through the assembly of fibre preforms positioned between first and second metallic members after consolidation and bonding to form a unitary composite component.

The resulting consolidated and diffusion bonded ceramic fibre reinforced metal component 60 is shown in FIG. 6, which shows the ceramic fibres 14 and the diffusion bond region 62. Additionally the provision of the grooves, or chambers, 42 and 44 allows the annular projection 38 to move during the consolidation process and in so doing this results in the formation of a recess 63 in the surface of what was the second metal ring. The recess 63 indicates that successful consolidation and diffusion bonding has occurred.

Figure 7:
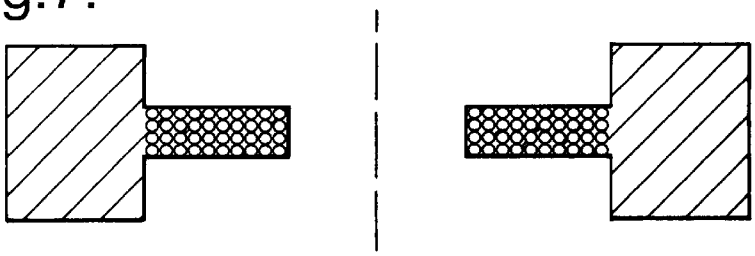
FIG. 7 is a part longitudinal cross-sectional view through the unitary composite component after machining.

After consolidation and diffusion bonding the component is machined to remove at least a portion of what was originally the second metal ring and at least a portion of the diffusion bond region, as shown in FIG. 7. It is preferred to remove as much of the diffusion bond region as is practically possible, and this entails removing the majority or substantially the whole of the second metallic ring.

Figure 8:
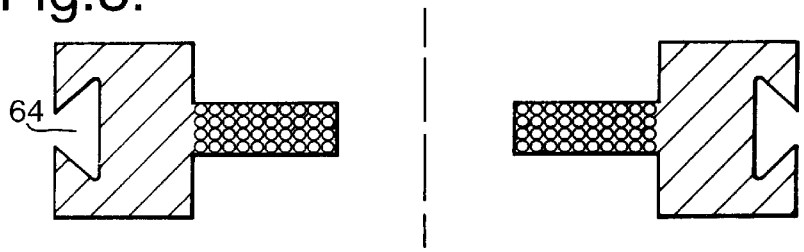
FIG. 8 is a part longitudinal cross-sectional view through the unitary composite component of FIG. 7 after further machining to form a peripheral circumferential groove.
Figure 9:
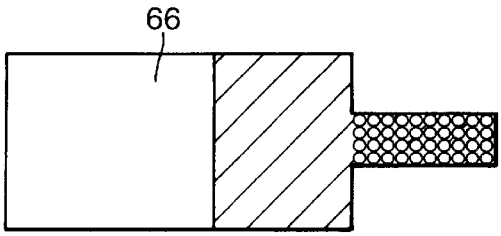
FIG. 9 is a part longitudinal cross-sectional view through the unitary composite component of FIG. 7 after further machining to form peripheral axial grooves.
Figure 10:
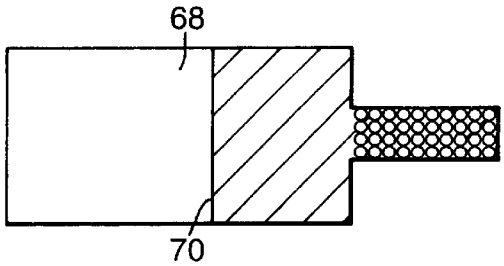
FIG. 10 is a part longitudinal cross-sectional view through the unitary composite component of FIG. 7 after machining to form integral peripheral rotor blades.

If the first metal ring 30 had a relatively small outer diameter, as shown in FIGS. 8 and 9, the periphery of the machined consolidated and diffusion bonded component is further machined to form either a single circumferentially extending groove 64 as shown in FIG. 8 to receive the shaped roots of rotor blades, or is further machined to form a plurality of axially extending grooves 66 as shown in FIG. 9 to receive the shaped roots of rotor blades. Alternatively rotor blades 68 may be welded onto the periphery 70 of the machined consolidated and diffusion bonded component as shown in FIG. 10 by friction welding, laser welding or electron beam welding.

Figure 11:
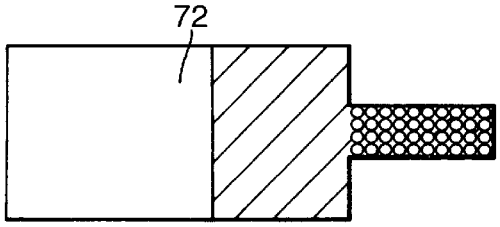
FIG. 11 is a part longitudinal cross-sectional view through the unitary composite component of FIG. 7 after welding of rotor blades.

Alternatively if the first metal ring 30 had a relatively large outer diameter, as shown in FIGS. 11 the periphery of the machined consolidated and diffusion bonded component is further machined to form integral rotor blades 72 for example by electrochemical machining.

Although the description has referred to a plurality of metal coated ceramic fibres, each one of which is wound into a planar spiral, it may also be possible to use any arrangement of at least one circumferentially extending fibre and filler metal. For example other possibilities are a single metal coated fibre, a plurality of metal coated fibres, a single fibre and a single metal wire, a plurality of fibres and a plurality of metal wires, a single fibre and metal powder, a plurality of fibres and metal powder, a single fibre and a metal foil, or a plurality of fibres and a plurality of metal foils. The at least one circumferentially extending fibre and filler metal may comprise a helical tape of fibres and a helical tape of metal or one or more metal coated fibres wound in the annular groove in the first metal ring. Also one or more metal foils and one or more metal coated fibres may be used.

The first metal ring and the second metal ring may comprise titanium, titanium aluminide, an alloy of titanium, or any suitable metal, alloy or intermetallic which is capable of being bonded.

The at least one circumferentially extending fibre may comprise silicon carbide, silicon nitride, boron, alumina, or other suitable fibre.

The metal coating, metal powder, metal wire and metal foil may comprise titanium, titanium aluminide, an alloy of titanium, or any suitable metal, alloy or intermetallic which is capable of being bonded.

Although the invention has been described with reference to metal rings or metal discs it is equally applicable to other metal structures.

Although the invention has been described by use of hot isostatic pressing it is possible to use vacuum hot pressing.

The advantage of the invention is that it uses a single thermal cycle to consolidate the fibre preforms and to bond the fibre preform, the first and second metal rings together. Additionally it does not require the use of a vacuum hot press, nor does it require the use of special tools to hold the two metal rings during consolidation and bonding.

It is also possible to define the chambers between the confronting faces of the first and second metallic members on either side of the longitudinally extending projection on the second metallic member by providing one or more third metallic members between the confronting faces of the first and second metallic members such that the third metallic members are spaced from the projection, preferably the third metallic member(s) are at adjacent the periphery of the first and second metallic members.

We claim:

1. A method of manufacturing a fibre reinforced metal component comprising the steps of:

(a) forming a longitudinally extending groove in a face of a first metallic member, (b) arranging at least one longitudinally extending fibre and filler metal in the groove in the first metallic member, (c) forming a longitudinally extending projection on a face of a second metallic member, (d) arranging the second metallic member such that the longitudinally extending projection of the second metallic member is aligned with the longitudinally extending groove of the first metallic member and such that two longitudinally extending chambers are formed between the said faces of the first and second metallic members, the longitudinally extending chambers being arranged transversely on opposite sides of the longitudinally extending projection, (e) applying heat and pressure such that the longitudinally extending projection moves into the longitudinally extending groove to consolidate the at least one longitudinally extending fibre and the filler metal and to bond the first metallic member, the second metallic member, the at least one longitudinally extending fibre and the filler metal to form a unitary composite component.

2. A method as claimed in claim 1 comprising forming a circumferentially extending groove in an axial face of the first metallic member, arranging at least one circumferentially extending fibre and filler metal in the groove in the first metallic member, forming a circumferentially extending projection on an axial face of the second metallic member, arranging the second metallic member such that the circumferentially extending projection of the second metallic member is aligned with the circumferentially extending groove of the first metallic member and such that two circumferentially extending chambers are formed between the said faces of the first and second metallic members, the circumferentially extending chambers being arranged radially on opposite sides of the circumferentially extending projection, applying heat and pressure such that the circumferentially extending projection moves into the circumferentially extending groove to axially consolidate the at least one circumferentially extending fibre and the filler metal and to bond the first metallic member, the second metallic member, the at least one circumferentially extending fibre and the filler metal to form a unitary composite component.

3. A method as claimed in claim 1 or claim 2 comprising the step of sealing the periphery of the first metallic member to the periphery of the second metallic member after step (d) and before step (e).

4. A method as claimed in claim 1 wherein step (e) comprises hot isostatic pressing.

5. A method as claimed in claim 1 wherein the first metallic member is selected from the group comprising a ring and disc and the second metallic member is selected from the group comprising a ring and disc.

6. A method as claimed in claim 1 wherein the at least one longitudinally extending fibre and filler metal are selected from the group comprising a single metal coated fibre, a plurality of metal coated fibres, a single fibre and a single metal wire, a plurality of fibres and a plurality of metal wires, a single fibre and metal powder, a plurality of fibres and metal powder, a single fibre and a metal foil, and a plurality of fibres and a plurality of metal foils.

7. A method as claimed in claim 1 wherein the at least one longitudinally extending fibre and filler metal are selected from the group comprising a helical tape of fibres and a helical tape of metal and at least one metal coated fibre, each metal coated fibre is wound in a spiral to form a disc shaped preform.

8. A method as claimed in claim 1 wherein the first metallic member and the second metallic member are selected from the group comprising titanium, titanium aluminide, an alloy of titanium, and any suitable metal, alloy or intermetallic which is capable of being bonded.

9. A method as claimed in claim 1 wherein the at least one longitudinally extending fibre is selected from the group comprising silicon carbide, silicon nitride, boron, alumina.

10. A method as claimed in claim 1 wherein the filler metal is selected from the group comprising titanium, titanium aluminide, an alloy of titanium, and a metal, alloy or intermetallic which is capable of being bonded.

11. A method as claimed in claim 3 wherein the sealing of the periphery of the first metallic member to the periphery of the second metallic member comprises welding.

12. A method as claimed in claim 1 wherein the method additionally comprises the step of machining the unitary composite component to a predetermined shape after step (e).

13. A method as claimed in claim 12 wherein the machining comprises machining the unitary composite component to remove at least a portion of the second metallic member and at least a portion of the bond between the first metallic member and the second metallic member.

14. A method as claimed in claim 12 wherein the machining comprises machining at least one axial, or circumferential, groove in the periphery of the unitary composite component, for receiving rotor blade attachment features.

15. A method as claimed in claim 12 wherein the machining comprises machining the periphery of the unitary composite component to form at least one rotor blade integral with the unitary composite component.

16. A method as claimed in claim 15 wherein the unitary composite component is electrochemically machined to form the at least one rotor blade.

17. A method as claimed in claim 12 wherein the method comprises the additional step of welding at least one rotor blade to the unitary composite component.

18. A method as claimed in claim 17 wherein the at least one rotor blade is welded onto the unitary composite component by friction welding or electron beam welding.

19. A method as claimed in claim 1 wherein said projection has a base and the chambers between the said faces of the first and second metallic members are tapered transversely from the face of the first metallic member to the base of the projection.

20. A method as claimed in claim 19 wherein the chambers taper in a straight line or taper in a curve.

21. A method as claimed in claim 1 wherein the shape of the chambers are tailored to control the movement of the projection of the second metallic member into the groove in the first metallic member during the consolidation and bonding step.

22. A method as claimed in claim 1 wherein the at least one longitudinally extending fibre has adhesive to hold the fibre in a preform.

23. A method as claimed in claim 22 wherein the projection has axial grooves to allow the adhesive to be removed from the at least one longitudinally extending fibre in the longitudinally extending groove in the first metallic member.

24. A method as claimed in claim 1 comprising forming the chambers between the said faces of the first and second metallic members by machining two grooves in said face of the second metallic member.

25. A method as claimed in claim 1 comprising forming the chambers between the said faces of the first and second metallic members by locating at least one third metallic member between the first and second metallic members and spacing the at least one third metallic member from the projection on the second metallic member.

26. A method of manufacturing a fibre reinforced metal component comprising the steps of:

(a) forming a circumferentially and axially extending groove in an axial face of a first metallic member, (b) arranging at least one circumferentially extending fibre and filler metal in the groove in the first metallic member, (c) forming a circumferentially and axially extending projection on an axial face of a second metallic member, (d) arranging the second metallic member such that the circumferentially extending projection of the second metallic member is aligned with the circumferentially extending groove of the first metallic member and such that two circumferentially extending chambers are formed between the said axial faces of the first and second metallic members, the circumferentially extending chambers being arranged radially on opposite sides of the circumferentially extending projection, (e) applying heat and pressure such that the circumferentially extending projection moves into the circumferentially extending groove to axially consolidate the at least one circumferentially extending fibre and the filler metal and to bond the first metallic member, the second metallic member, the at least one circumferentially extending fibre and the filler metal to form a unitary composite component.

* * * * *